US006381867B1

(12) United States Patent
Polato

(10) Patent No.: US 6,381,867 B1
(45) Date of Patent: May 7, 2002

(54) STABILIZED HIGH VACUUM DRYING INSTALLATION FOR INDUSTRIAL HIDES AND SIMILAR PRODUCTS

(76) Inventor: Antonio Polato, Via Col Roigo, 3, 36065 Mussolente (Vicenza) (IT)

( * ) Notice: Subject to any disclaimer, the term of this patent is extended or adjusted under 35 U.S.C. 154(b) by 0 days.

(21) Appl. No.: 09/700,030

(22) PCT Filed: Jun. 28, 1999

(86) PCT No.: PCT/IB99/01212

§ 371 Date: Nov. 3, 2000

§ 102(e) Date: Nov. 3, 2000

(87) PCT Pub. No.: WO00/00777

PCT Pub. Date: Jan. 6, 2000

(30) Foreign Application Priority Data

Jun. 29, 1998 (IT) ..... VI98A0127

(51) Int. Cl.[7] ..... F26B 13/30
(52) U.S. Cl. ..... 34/92; 34/621
(58) Field of Search ..... 34/92, 635, 412, 34/77, 263, 621

(56) References Cited

U.S. PATENT DOCUMENTS

| | | | | | |
|---|---|---|---|---|---|
| 3,949,485 | A | * | 4/1976 | Fuhring et al. | 34/412 |
| 3,987,556 | A | * | 10/1976 | Tissot et al. | 34/635 |
| 4,268,247 | A | * | 5/1981 | Freze | 34/77 |
| 4,438,570 | A | * | 3/1984 | Dokoupil | 34/92 |
| 5,033,206 | A | * | 7/1991 | Corner | 34/92 |
| 5,056,239 | A | * | 10/1991 | Corner | 34/92 |
| 5,122,233 | A | * | 6/1992 | Zampieri | 34/92 |
| 5,263,268 | A | | 11/1993 | Meeks et al. | |
| 5,671,546 | A | | 9/1997 | Haala | |
| 5,860,222 | A | * | 1/1999 | Leander | 34/92 |
| 6,076,273 | A | * | 6/2000 | Corner | 34/92 |
| 6,092,301 | A | * | 7/2000 | Komanowsky | 34/263 |
| 6,178,659 | B1 | * | 1/2001 | Corner et al. | 34/92 |

FOREIGN PATENT DOCUMENTS

| | | |
|---|---|---|
| GB | 625 703 A | of 1949 |
| WO | WO 94 21828 A | 9/1994 |
| WO | WO 94 23255 A | 10/1994 |
| WO | WO 98 01583 A | 1/1998 |

* cited by examiner

*Primary Examiner*—Teresa Walberg
*Assistant Examiner*—Fadi H. Dahbour
(74) *Attorney, Agent, or Firm*—Daniel O'Byrne

(57) ABSTRACT

A stabilised high vacuum drying installation for industrial hides and similar products includes a plurality of drying beds (2, 2', 2") with heating platforms (3, 3', 3") and hermetic covers (4, 4', 4"), vacuum means (7) connected to the drying beds to extract vapours coming from the hides and to reduce the pressure to minimum working values (Pi), a circuit with valve means (10, 10', 10"; 11, 11', 11") to selectively connect the drying beds to the vacuum means. The valve means include, downstream of every drying bed, at least one cutoff valve (10, 10', 10") for selectively connecting such bed, initially at atmospheric pressure, to the vacuum means (7), and at least one check valve (11, 11', 11") for isolating automatically the remaining beds already at working pressure so as to avoid pressure oscillations in their interior. The vacuum means (7) include a primary vacuum pump (8) suitable to reduce the pressure in the circuit to a predetermined value (Ps) superior to the working minimum value (Pi) and a secondary vacuum pump (9) suitable to co-operate with the primary vacuum pump (8) to reduce the pressure in the circuit to the minimum working value (Pi).

10 Claims, 1 Drawing Sheet

STABILIZED HIGH VACUUM DRYING INSTALLATION FOR INDUSTRIAL HIDES AND SIMILAR PRODUCTS

TECHNICAL FIELD

The object of the present invention is to provide a stabilised high vacuum drying installation for industrial hides and similar products. Drying installations of this kind are normally used in tanning industry to eliminate water and residual moisture from hides after tanning treatment and before finishing processes.

BACKGROUND ART

Drying installations of the above type are known for a long time and include, in accordance with the preamble of claim 1, a plurality of drying beds for the products to be dried, including essentially a heating platform on which the hides are laid and which are closed by hermetic covers, vacuum means connected to the drying beds to aspirate vapours coming from the hides and reduce the pressure and the equilibrium temperature to a lower working value, and a circuit with valve means to selectively connect the drying beds to the vacuum means.

The vacuum means generally include one or more vacuum pumps, for example of the liquid ring type, a compressor, a blower or an ejector. Such vacuum devices can be placed in the aspiration circuit so as to work separately or in combination.

From the European patent No. 0 689 613 in the name of the same applicant, a high vacuum installation of the above mentioned type for industrial hides dryers is known, wherein the vacuum means include a vacuum pump for reducing progressively the pressure to a first predefined value corresponding to a first working temperature, and a secondary aspiration device is connected upstream of the main vacuum pump and working in series with the latter to further reduce the pressure so as to allow to increase instantaneously evaporation and/or to reduce the equilibrium temperature to a second value lower than the first one. With such installation, which is commonly considered overcharged or "turbocharged", it is possible to reduce drastically hide drying time while maintaining vapours equilibrium temperature within comparatively low values.

Alternatively, it will be possible to reduce noticeably the evaporation temperature by reducing drastically hide thermal stress and thus improving remarkably their final quality.

From EP-A-0 689 659, in the name of the same applicant, a vacuum installation for industrial dryers is known wherein the aspiration circuit provides valve means to connect every platform or drying bed, initially at atmospheric pressure, to the secondary aspiration device until a degree of vacuum close to the steady state is reached in that bed, and subsequently with the main vacuum pump so as to eliminate oscillations or pressure swingings in the remaining drying beds, which are under vacuum.

In practise, stabilised high vacuum installations are provided, in which both solutions offered by the two above-cited patents are present in order to attain both advantages, i.e. low evaporation temperature and pressure stabilisation in the drying beds.

However, such installation practically involves the use of at least three pumps, a main vacuum pump for the extraction of the vapours from the circuit, a secondary vacuum pump to reduce pressure in a drying bed in turn and an aspiration device like a compressor, blower or ejector to reduce further the pressure to the minimum working value.

PRESENTATION OF THE INVENTION

A primary object of the present invention is to eliminate the drawbacks described above by providing an installation for high vacuum industrial hide dryers with characteristics of high efficiency and relatively simple structure.

A particular object is to provide a vacuum installation of the above kind with a lower number of aspiration devices so as to reduce energy consumption and increase installation reliability.

In accordance with one preferred aspect of the present invention, there is provided a stabilised high vacuum drying installation for industrial hides and similar products comprising a plurality of drying beds comprising heating platforms and hermetic covers, vacuum means connected to the drying beds to extract vapours coming from the hides and reduce the pressure to minimum working value, a circuit with valve means to selectively connect said drying beds to said vacuum means, characterized by the fact that said valve means comprise, downstream of each drying bed, at least one cutoff valve for selectively connecting said bed, initially at atmospheric pressure, to the vacuum means, and at least one check valve for automatically isolating the remaining bed already at working pressure so as to avoid pressure oscillations internally thereof.

Thanks to the insertion of check valves downstream of the drying bed, it will be possible to eliminate one vacuum pump normally present in stabilised high vacuum installations to reduce the pressure, with consequent reduction of the complexity and operating costs of the installation.

BRIEF DESCRIPTION OF THE DRAWINGS

Further characteristics and advantages will become more apparent in the light of the following detailed description of a preferred but non exclusive embodiment of a high vacuum dryer installation according to the invention, illustrated by way of non limitative example with the aid of the enclosed drawing in which:

The FIG. 1 illustrates a schematic view of the stabilised high vacuum installation for industrial hides dryers.

DESCRIPTION OF A PREFERRED EMBODIMENT

Figure 1:
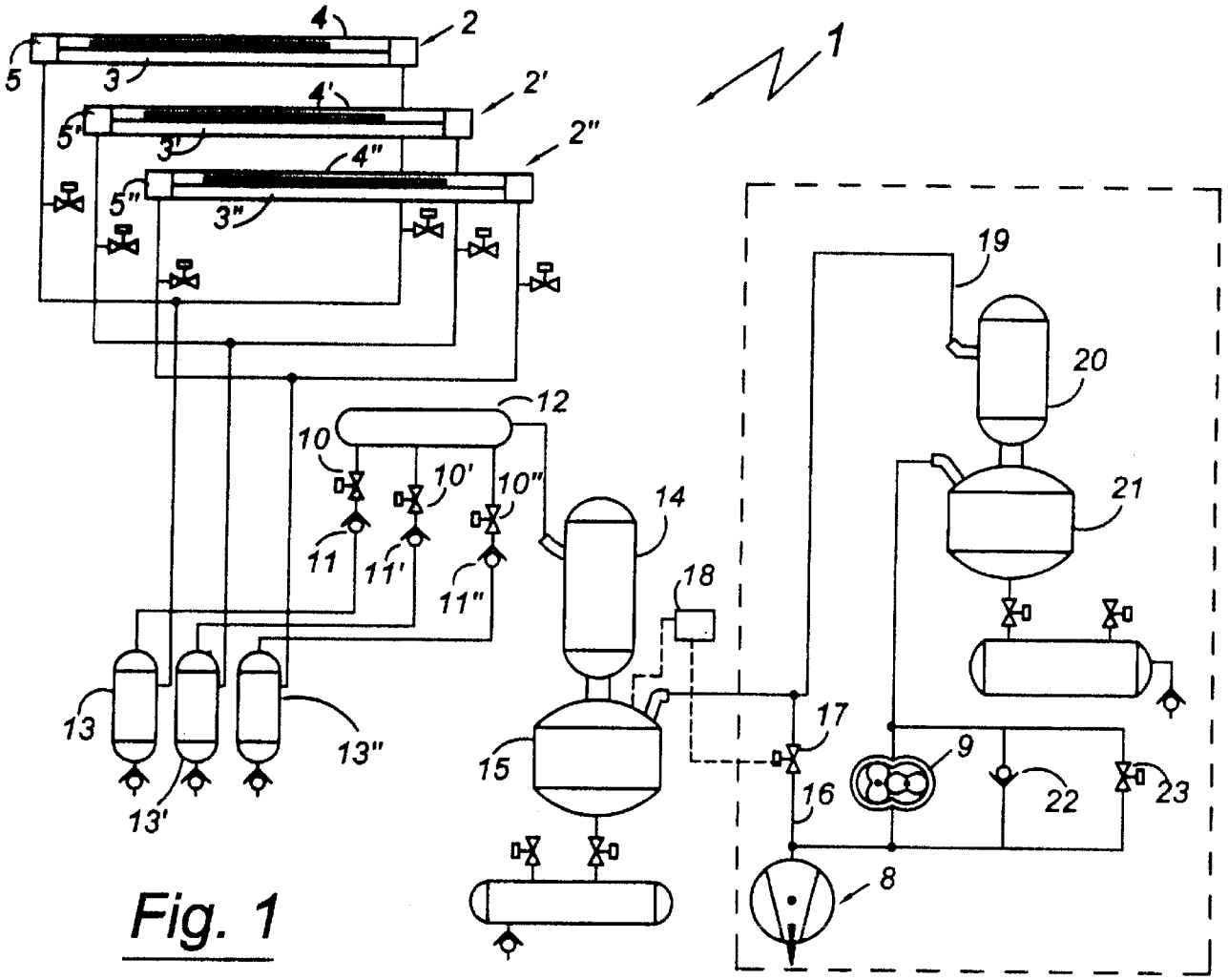

With reference to FIG. 1, a stabilised high vacuum installation is illustrated for industrial hide dryers, globally referenced with numeral 1, which includes essentially three or more drying beds respectively indicated 2, 2', 2", including respective heating platforms 3, 3', 3" closed by covers 4, 4', 4". The drying beds with the respective platforms can be superposed and movable along vertical guides not shown in the drawings.

Vapour collectors 5, 5', 5", 6, 6', 6" are associated to every drying bed and are connected to an aspiration and condensation circuit, which will be described below in detail.

Vacuum means are provided, which are enclosed in a part of the installation shown with a broken line and globally indicated with the reference numeral 7, including essentially a primary pump 8, preferably of the liquid ring type, and a high vacuum aspiration device 9, for example a vane blower or similar device.

Valve means are provided In the aspiration and condensation circuit to connect selectively the drying bed to the vacuum means.

According to the invention, the valve means are constituted by controlled cutoff valves or electric valves 10, 10', 10" placed downstream of the drying beds, particularly along the connection line with collectors 5, 5', 5" and 6, 6', 6". The function of these electric valves 10, 10', 10" is to connect selectively every drying bed 2, 2', 2" with pumps 8 and 9, so as to reduce progressively the pressure to a lower value Pi corresponding to a minimum working temperature, i.e. of hide vacuum drying.

According to the invention, the valve means include moreover check valves 11, 11', 11" that allow automatic isolation of every drying bed when the value of the downstream pressure is greater than the value inside the respective bed.

Preferably, an aspiration manifold 12 is provided downstream of the check valves 11, 11', 11" for all lines coming from the drying beds, possibly placed downstream of the respective condensate separators 13, 13', 13" and upstream of an additional condenser 14 provided with a condensate separator 15.

The vacuum means part 7 includes a first line 16 on which an electric by-pass valve 17 is placed, which is controlled by a sensor 18 adapted to detect the pressure value in the aspiration line, placed preferably above the condensate separator 15. The sensor 18 is adjusted so as to send a signal to the by-pass valve 17 at a predetermined value Ps of the pressure, greater than the lower pressure Pi and corresponding to the value at which the blower 9 is connected.

A second line 19 of the vacuum means section connects the outlet of the separator condensate 15 with the blower 9 by means of the possible interposition of an auxiliary condenser 20 and a condensate separator 21. On the circuit branches parallel to the line 19 a safety valve 22 and a by-pass valve can be provided.

Operatively, one of the drying beds 2, 2', 2", for example bed 2, initially at atmospheric pressure, is connected to the vacuum pump 8 by opening the respective cutoff valve 10. The pressure begins to decrease until a value Ps at which the air pressure switch sends a closing signal to the by-pass valve 17. In this manner, the flow of vapours will be directed toward the blower 9 which will start to work in series with the vacuum pump 8.

The correspondent cutoff valve 10' is opened to operate the second drying bed 2' and to connect the bed 2' with the vacuum section 7. In such conditions, the pressure in the aspiration line, and in particular in the vapour collector 12, will rise again by effect of the atmospheric pressure present in the bed 2', causing the automatic closing of the cutoff valve 11 downstream of the bed 2. In this way, bed 2 will be isolated from the aspiration line and its pressure will remain almost unchanged for a predefined time interval. In such interval, the pressure in drying bed 2' will decrease progressively until the value Ps, by means of vacuum pump 8 operation and then until the value Pi by means of the operation in series of pump 8 and blower 9. At this stage, the pressure in the aspiration line, and particularly in the vapour collector 12 will be equal or lower than the one in bed 2 and consequently the cutoff valve 11 is opened, allowing again communication of bed 2 also with the vacuum section 7.

The process is repeated for all drying beds until cycle completion.

From what is described above, it is apparent that the high vacuum drying installation according to the invention reaches the described aims and particularly it allows to obtain a substantial equilibrium of pressures inside the drying beds, avoiding the introduction of a further intermediate pump downstream of said beds.

The contents of Italian patent application No. VI98A000127, for which priority is claimed, are incorporated herein by reference.

What is claimed is:

1. A stabilized high vacuum drying installation for industrial hides and similar products comprising a plurality of drying beds provided with heating platforms and hermetic covers, vacuum means connected to the drying beds to extract vapors coming from the hides and to reduce the pressure to a minimum working value, a circuit with valve means to selectively connect said drying beds to said vacuum means, said valve means comprising at least one cutoff valve located downstream of each drying bed for selectively connecting said bed, initially at atmospheric pressure, to the vacuum means, and at least one check valve for isolating automatically the remaining beds already at working pressure so as to avoid pressure oscillations internally thereof.

2. High vacuum drying installation according to claim 1, wherein said vacuum means include a primary vacuum pump for reducing the pressure in the circuit to a predefined value superior to the minimum working value.

3. High vacuum drying installation according to claim 2, wherein said vacuum means further include a secondary vacuum pump for co-operating with said primary vacuum pump to reduce the pressure in the circuit to said minimum working value.

4. High vacuum drying installation according to claim 3, wherein said secondary vacuum pump is a blower.

5. High vacuum drying installation according to claim 3, wherein said circuit includes a bypass valve for selectively excluding from the circuit said secondary pump.

6. High vacuum drying installation according to claim 5, further comprising an aspiration manifold located upstream of said vacuum means, to collect the vapors coming from said beds.

7. High vacuum drying installation according to claim 5, further comprising a pressure detector placed downstream of said vapor collector to detect the actual pressure existing in the circuit.

8. High vacuum drying installation according to claim 7, wherein said pressure detector is an air pressure switch.

9. High vacuum drying installation according to claim 8, wherein said air pressure switch is connected to said by-pass valve to activate said secondary pump when reaching a predetermined pressure value higher than said minimum working value.

10. A stabilized high vacuum drying installation for industrial hides and similar products comprising a plurality of drying beds provided with heating platforms and hermetic covers, a vacuum device connected to the drying beds to extract vapors coming from the hides and to reduce the pressure to a minimum working value, a circuit with a valve device adapted to selectively connect said drying beds to said vacuum device, said valve device comprising at least one cutoff valve located downstream of each drying bed for selectively connecting said bed, initially at atmospheric pressure, to the vacuum device, and at least one check valve for isolating automatically the remaining beds already at working pressure so as to avoid pressure oscillations internally thereof.

* * * * *